US007424785B2

(12) United States Patent
Feroli et al.

(10) Patent No.: US 7,424,785 B2
(45) Date of Patent: Sep. 16, 2008

(54) LABEL CASSETTE FOR AN ELECTRONICS ENCLOSURE

(75) Inventors: Lawrence J. Feroli, W. Townsend, MA (US); W. Brian Cunningham, Westborough, MA (US); C. Ilhan Gundogan, Lexington, MA (US); Albert F. Beinor, Jr., Sutton, MA (US); Michael John Kozel, Upton, MA (US)

(73) Assignee: EMC Corporation, Hopkinton, MA (US)

( * ) Notice: Subject to any disclaimer, the term of this patent is extended or adjusted under 35 U.S.C. 154(b) by 475 days.

(21) Appl. No.: 11/017,244

(22) Filed: Dec. 20, 2004

(65) Prior Publication Data

US 2006/0150458 A1 Jul. 13, 2006

(51) Int. Cl.
*G09F 3/18* (2006.01)

(52) U.S. Cl. ..... 40/649; 40/653; 40/661; 40/661.06; 361/683

(58) Field of Classification Search ..... 40/642.02, 40/649, 651, 653, 661, 661.06, 661.07, 652, 40/654, 606.08; 361/683, 684, 685
See application file for complete search history.

(56) References Cited

U.S. PATENT DOCUMENTS 4,866,868 A * 9/1989 Kass ..... 40/661
5,331,758 A * 7/1994 Romick ..... 40/661
5,432,673 A * 7/1995 Ogami et al. ..... 361/684
6,069,596 A * 5/2000 Marvin et al. ..... 345/52
6,718,674 B2 * 4/2004 Caveney et al. ..... 40/642.02
6,877,264 B2 * 4/2005 Mautz ..... 40/663
2004/0154197 A1 * 8/2004 Hishinuma et al. ..... 40/375
2004/0165347 A1 * 8/2004 Roesner et al. ..... 361/683
2006/0161936 A1 * 7/2006 Permut et al. ..... 720/657
2006/0250766 A1 * 11/2006 Blaalid et al. ..... 361/685

FOREIGN PATENT DOCUMENTS

WO WO 02/098679 * 12/2002

* cited by examiner

*Primary Examiner*—Gary C Hoge
(74) *Attorney, Agent, or Firm*—Guerin & Rodriguez, LLP; Michael A. Rodriguez

(57) ABSTRACT

Described is a label cassette for mounting to the front side of an enclosure and for holding and displaying a label used to identify a configuration of that enclosure. The label cassette includes a transparent cover, a tray, and a hinge mechanism. The tray has a pair of guide rails for engaging respective guide structures on the enclosure to align the label cassette for attachment to the enclosure, a capture mechanism to secure the label cassette to the enclosure, and a label surface to hold a label. The hinge mechanism attaches the transparent cover to the tray and permits rotation about an axis parallel to the back edge of the transparent cover. Mounted to a ledge that extends from the front of the enclosure, the label cassette does not occupy vertical space or interfere with connectors, cables, or airflow vents on the front of the enclosure.

19 Claims, 4 Drawing Sheets

LABEL CASSETTE FOR AN ELECTRONICS ENCLOSURE

FIELD OF THE INVENTION

The invention relates generally to electronics systems. More particularly, the invention relates to a label assembly that mounts to and identifies an electronics enclosure.

BACKGROUND

Shelf-mounted electronics enclosures are often vertically stacked in a rack or similar structure. Although the various enclosures within a rack can look similar, each enclosure may perform a different function, depending upon its particular configuration. Technical personnel working with the enclosures need to be able to determine quickly the configuration of a particular enclosure. One common technique is to attach an adhesive label to the front panel of the electronics enclosure, where a technician can readily see and read the label.

Placing labels on the front panel, however, encounters various problems. For one, cables attached to connectors or ports on the front side of an enclosure can limit the area on which to attach a label. Placement of the label needs to be such that the cables do not obstruct one's ability to read it. In addition, the front side of the enclosure can include vents or openings to permit the inflow of cooling air or the exhaust of heated air. Attachment of a label over these openings can block airflow and, thus, adversely affect the operation of electronic components and modules within the electronics enclosure.

Thus, there is a need for a labeling mechanism for an electronics enclosure that is easily viewable by personnel, does not interfere with the flow of air through vents, is inexpensive, easy to install, and permits rapid label replacement.

SUMMARY OF THE INVENTION

In one aspect, the invention features a label cassette for an electronics enclosure. The label cassette includes a tray, a transparent cover having a back edge, and a hinge mechanism. The tray has a guide rail for slidably engaging a guide structure of the electronics enclosure. The tray also includes a capture mechanism for securing the tray to a surface of the electronics enclosure when the guide rail engages the guide structure, and a label surface for holding a label. The hinge mechanism rotatably attaches the transparent cover to the tray for rotation about an axis substantially parallel to the back edge of the transparent cover.

In another aspect, the invention features an electronics enclosure including a base and an external ledge extending from the base. The ledge has a surface with an opening formed therein and a guide structure disposed along one side of the surface. The enclosure also includes a label cassette having a transparent cover with a back edge, a tray, and a hinge mechanism. The tray has a guide rail for slidably engaging the guide structure of the ledge when attaching the label cassette thereto, a capture mechanism for securing the tray to the surface of the ledge when the guide rail engages the guide structure, and a label surface for holding a label. The hinge mechanism rotatably attaches the transparent cover to the tray for rotation about an axis substantially parallel to the back edge of the transparent cover.

In yet another aspect, the invention features an electronics enclosure having spaced-apart opposing side walls and a base panel disposed between and substantially perpendicular to the side walls. The base panel extends beyond one end of each spaced-apart side wall to form a ledge portion having a surface. The enclosure also has means for holding and displaying a label and means for mounting the holding and displaying means to the surface of the ledge portion.

BRIEF DESCRIPTION OF THE DRAWINGS

The above and further advantages of this invention may be better understood by referring to the following description in conjunction with the accompanying drawings, in which like numerals indicate like structural elements and features in various figures. The drawings are not necessarily to scale, emphasis instead being placed upon illustrating the principles of the invention.

DETAILED DESCRIPTION

The invention features a label assembly, also referred to as a label cassette, for mounting to an electronics enclosure and for holding and displaying a label that provides identifying information about that electronics enclosure. A variety of electronics systems, such as storage systems and network systems, can use label cassettes of the invention to identify the types of electronics enclosures and modules in the system. Mounted to a ledge that extends horizontally from the front of the enclosure, the label cassette does not occupy valuable vertical space. Additionally, the label cassette does not interfere with airflow vents on the front of the electronics enclosure, or with any electrical or optical cables connected to the front panel of the enclosure. Technicians can quickly and easily remove a current label from the label cassette and insert a new label when changing the identifying information for the electronics enclosure.

Figure 1:
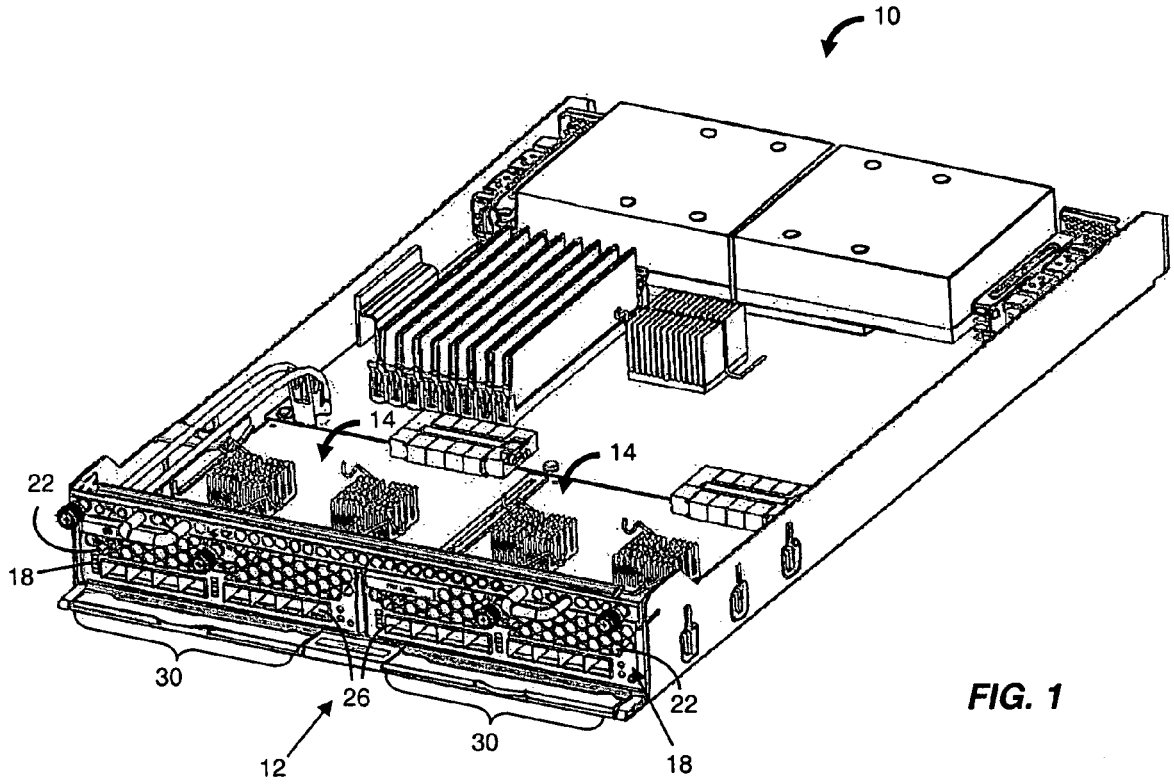
FIG. 1 is an isometric view of an embodiment of an electronics enclosure having a plurality of label cassettes of the present invention.

FIG. 1 shows an embodiment of an electronics enclosure 10 constructed in accordance with the invention. Omitted from FIG. 1 is a cover for the enclosure 10 so that various internal components, such as memory modules, I/O modules, processors, power supplies, heat sinks and the like, are visible. A plurality of replaceable modules 14 are disposed at a front end (denoted by arrow 12) of the enclosure 10. Front panels 18 of the modules 14 include openings 22 so that air can pass into the enclosure 10 and cool the internal components. The front panel 18 of each module 14 also has an array of connector ports 26 for receiving cables that couple the modules 14 to other electronics enclosures, modules or external equipment.

A plurality of label cassettes 30 of the present invention are shown extending horizontally away from the base of the enclosure 10. Here, each label cassette 30 is disposed in front of one of the modules 14 for which that label cassette 30 is providing identifying information. Being located near the base, the label cassettes 30 do not impede the passage of air through the openings 22 or interfere with any cables (not shown) extending from the connector ports 26. In the embodiment shown, the label cassettes 30 are substantially perpendicular to the front panels 18 of the modules 14. In other embodiments, each label cassette 30 can slope slightly downwards. Although the enclosure 10 of FIG. 1 has two label cassettes 30, other embodiments can have only one label cassette 30 or more than two label cassettes 30 without departing from the principles of the invention.

Figure 2:
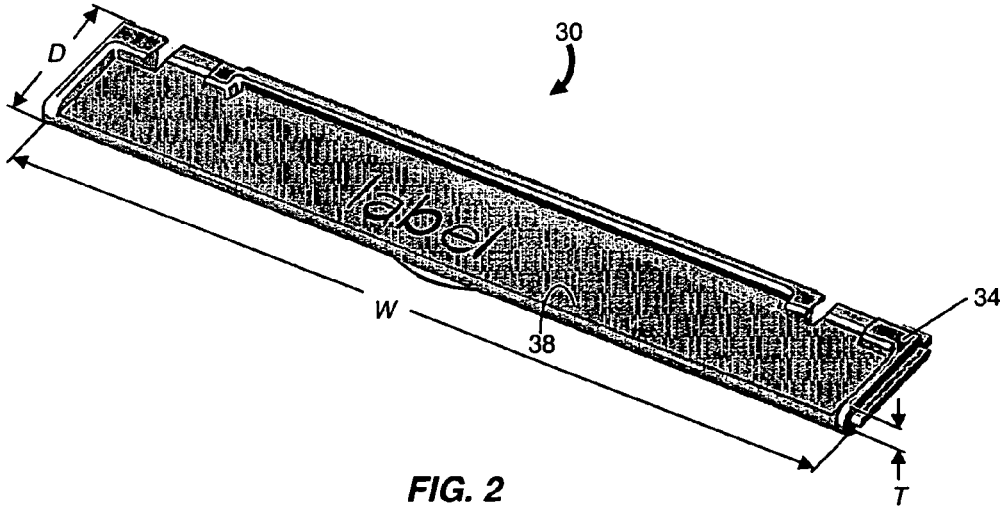
FIG. 2 is an isometric view of an embodiment of a label cassette in a closed configuration in accordance with the invention.

FIG. 2 shows one embodiment of each label cassette 30 including a tray 34 and a transparent cover 38 in a closed position. The cover 38 is rotatably attached to a back edge of the tray 34, as described in more detail below. The label cassette 30 is generally rectangular and holds a label (identified by the word "label") on the tray 34 below the transparent cover 38. The label can have text description or a graphic depiction that serves to identify the module 14 in front of which the label cassette 30 is mounted. The transparency of the cover 38 permits a viewer to see and read the label. In one embodiment, the label cassette 30 has a width W of approximately 4.0 in., a depth D of 1.0 in., and a thickness T of less than 0.19 in. Label cassettes 30 of the invention can be constructed in various sizes. In addition, the tray 34 and cover 38 of the label cassette 30 can each be made of injection-molded plastic.

Figure 3:
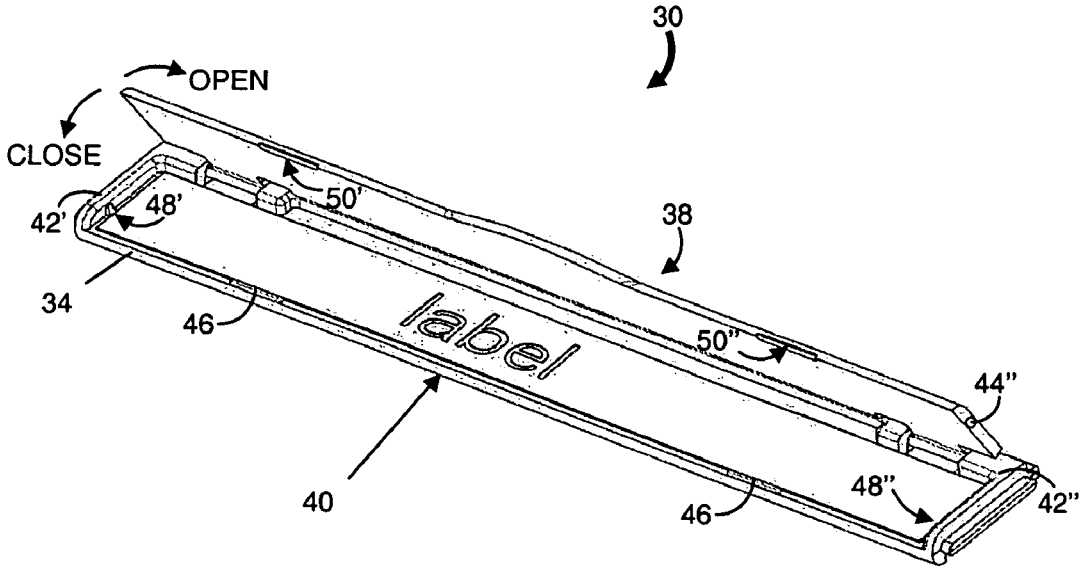
FIG. 3 is an isometric view of the label cassette of FIG. 2 in an open configuration.

FIG. 3 shows the label cassette 30 with the transparent cover 38 in an open position, being rotated away from the tray 34 about an axis parallel to the tray's back edge. The tray 34 has a left shoulder 42' and a right shoulder 42" (generally, 42) and a plurality of tabs 46 extending upward from a front edge 40 of the tray 34. An inside surface of each shoulder 42 has an indentation 48', 48" (here, visible only on the left shoulder 42'). The cover 38 has a plurality of recesses 50', 50" (generally 50) located on a front edge of the cover 38. Each recess 50 receives one of the tabs 46 of the tray 34 when the cover 38 is rotated into the closed position (shown in FIG. 2). In addition, the cover 38 has a protrusion 44 on each of its side edges (in FIG. 3, only the protrusion 44" is visible on the right side edge) that snaps into a respective one of the recesses 50 when the cover 38 is closed. The label can be a paper, cardboard, plastic, or metallic card sized to sit within the tray 34, held in place by the shoulders 42', 42" and the tabs 46. Labels are not permanently secured within the tray 34, and thus can be easily removed and replaced with a different label.

Figure 4:
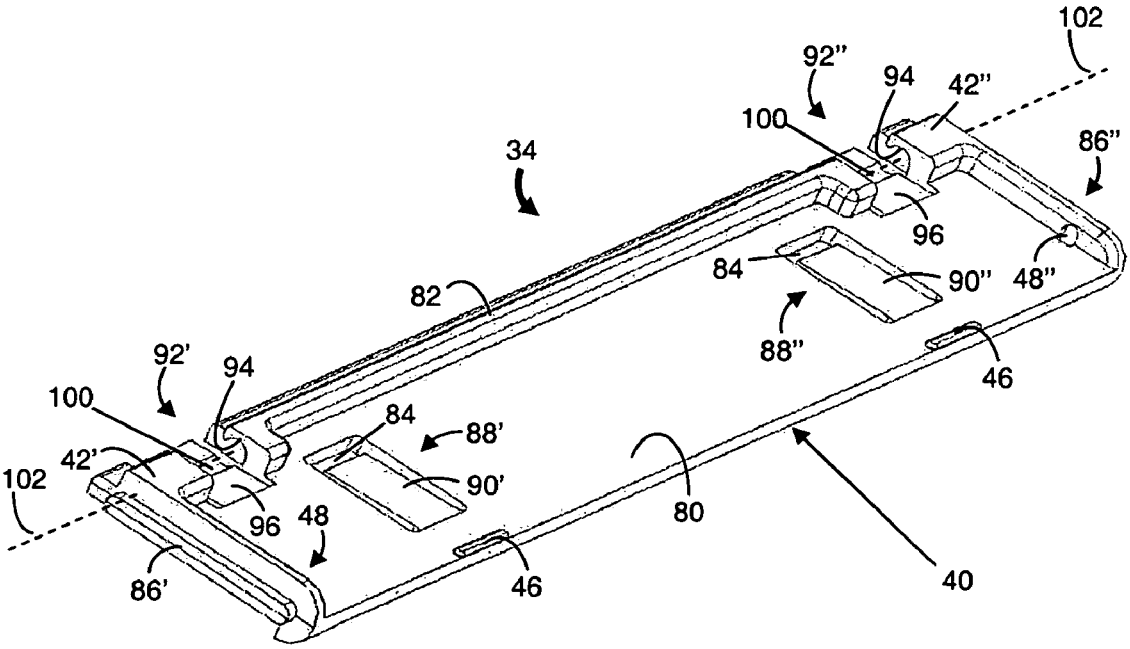
FIG. 4 is an isometric view of the topside of the tray of the label cassette of FIG. 2.
Figure 5:
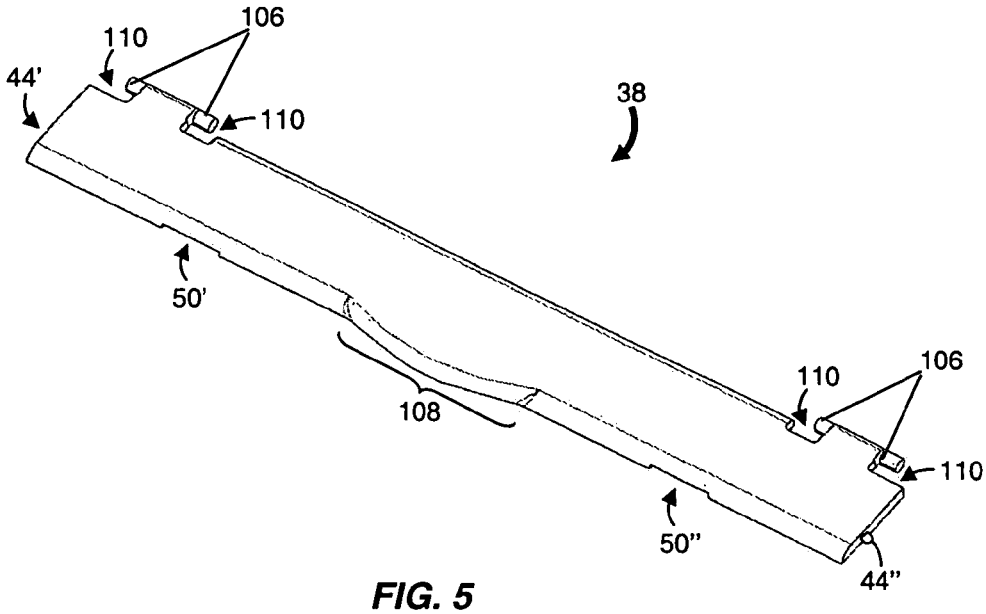
FIG. 5 is an isometric view of the transparent cover of the label cassette of FIG. 2.
Figure 6:
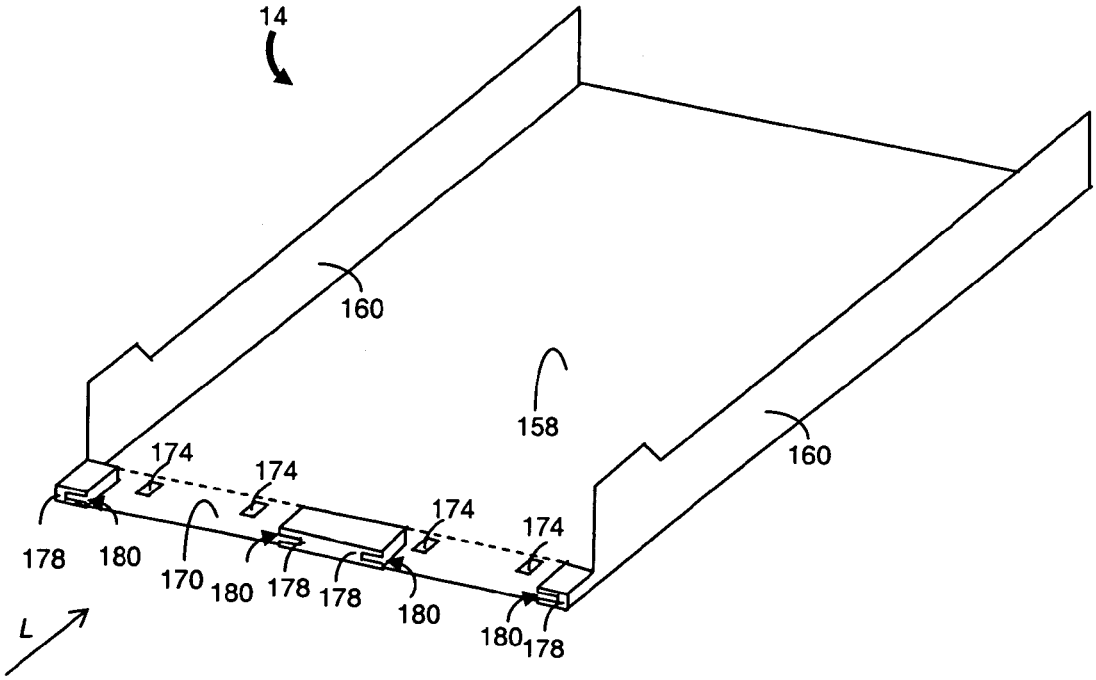
FIG. 6 is an isometric view of an electronics enclosure adapted for receiving two label cassettes of FIG. 2.

FIG. 4 shows a top view of the tray 34 of FIG. 3 in more detail (without a label). The tray 34 has a label surface 80 bounded by the shoulders 42, the tabs 46, and a back shoulder 82. Openings 84 in the label surface 80 have capture mechanisms 88' and 88" (generally 88) that extend downward from the label surface 80. In the illustrated embodiment, the capture mechanisms 88 include flexible beams 90', 90" (generally, 90) with hooked ends 122 (FIG. 5) to engage openings in a surface of the electronics enclosure 10 (FIG. 6). Elongated guide rails 86 project from and extend laterally along each side of the tray 34. The guide rails 86 and capture mechanisms 88 align and secure the label cassette 30 to the enclosure 10, as described in more detail below.

A pair of hinge pin retainers 92' and 92" (generally 92) is located along the back edge of the tray 34. Each hinge pin retainer 92 includes a flexible beam 96 having an upward-facing curved surface 100. Each hinge pin retainer 92 also includes downward-facing curved surfaces 94 on opposite lateral sides of the flexible beam 96. The curvatures of the curved surfaces 94 and 100 are closely sized to the curvature of a respective mating hinge pin 106 (FIG. 5) of the cover 38. Each hinge pin retainer 92, in conjunction with a respective hinge pin 106 of the cover 38, defines a hinge mechanism that enables the transparent cover 38 to be rotated relative to the tray 34, about an axis 102 extending through the curved surfaces 94, 100. FIG. 5 shows the cover 38 including a pair of hinge pins 106 along a back edge of the cover 38. The size of the hinge pins 106 is such that the hinge pins 106 fit closely within the curved surfaces 94, 100 of the tray 34.

Referring to FIG. 4 and FIG. 5, attachment of the transparent cover 38 to the tray 34 is achieved by urging each hinge pin 106 into a respective hinge pin retainer 92. Recesses 110 along the back edge of the cover 38 accommodate those portions of the shoulders 42 and back shoulder 82 that have the curved surfaces 94, 100. Initially, the flexible beams 96 deflect downward upon contacting the hinge pins 106. Once the hinge pins 106 advance to the curved surfaces 94, 100, the flexible beams 96 snap back (i.e., upward) to secure the hinge pins 106. While secured within the curved surfaces 94, 100 of a respective hinge pin retainer 92, each hinge pin 106 can rotate about the axis 102.

To install or replace a label in the label cassette 30, an individual can lift the transparent cover 38 using the edge extension 108 and rotate the cover 38 away from the tray 34. After insertion or replacement of the label, the cover 38 is rotated back towards the tray 34 until the protrusions 44 contact the shoulders 42. Additional force on the cover 38 snaps the protrusions 44 into respective indentations 48 in the shoulders 42, thereby "locking" the cover 38 in place. The recesses 50 along the front edge of the cover 38 receive the tabs 46 on the front edge 40 of the tray 34 when the label cassette 30 is closed. The curvature of the front edge of the cover 38 matches the curvature of the front portion of the shoulders 42 to produce a continuous round edge from shoulder 42' to shoulder 42" when the cover 38 is closed.

FIG. 6 shows a base portion of the electronics enclosure 10 of FIG. 1 (without any internal components). The electronics enclosure 10 includes a base panel 158 and spaced-apart opposing side walls 160. In one embodiment, the enclosure 10 is constructed of sheet metal. The base panel 158 includes a ledge portion 170 that extends forward of the enclosure 10. The ledge portion 170 has openings 174 and guide structures 178. The guide structures 178 are disposed in the center of and on opposite ends of the ledge portion 170 and are slightly raised above the plane of the base panel 158. Each guide structure 178 has a lateral slot 180 that is sized to receive a guide rail 86 on the side of the tray 34. The distance between each pair of guide structures 178 corresponds to the width of the label cassette 30.

Figure 7:
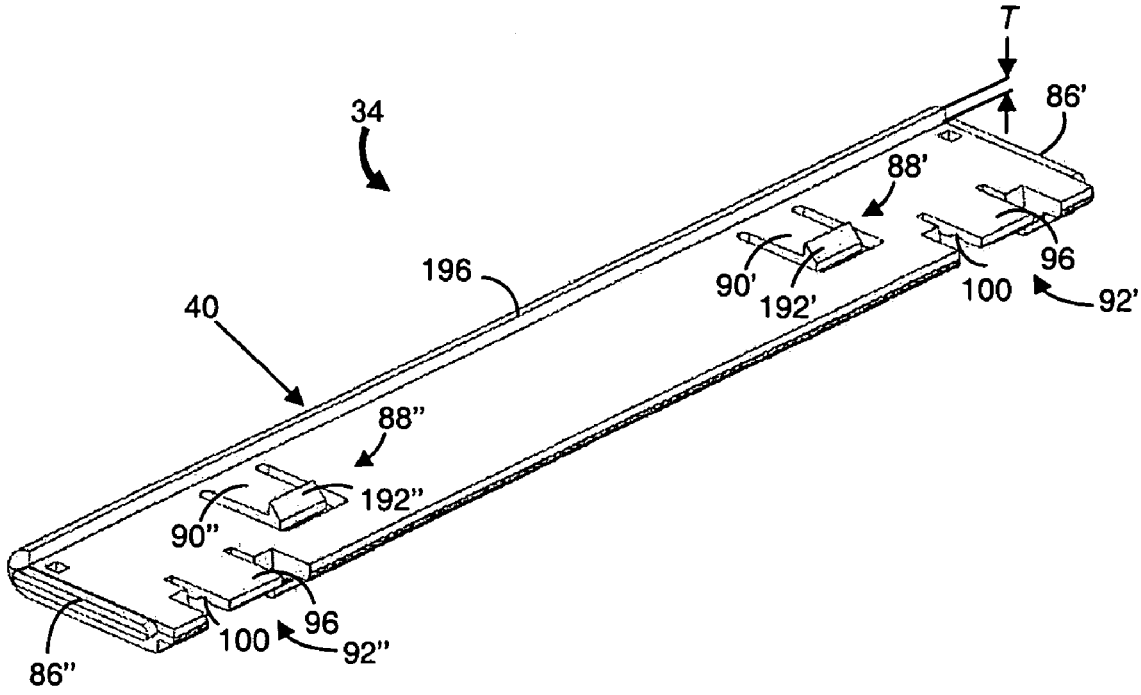
FIG. 7 is another isometric view of the underside of the tray of the label cassette shown in FIG. 4.

FIG. 7 shows a bottom view of the tray 34 and of the capture mechanisms 88. Each flexible beam 90 has a hooked end 192 that projects slightly below the plane of the tray 34. A lip 196 extends along the length of the front edge 40 of the tray 34 and projects slightly below the plane of the tray 34. The lip 196 has a thickness T that is approximately equal to the thickness of the ledge portion 170.

Referring to FIG. 6 and FIG. 7, each label cassette 30 attaches to the ledge portion 170 of the enclosure 10 by sliding the guide rails 86 of the tray 34 into the slots 180 in two guide structures 178. Horizontal and vertical alignment is provided by the guide structures 178, i.e., the cassette 30 is limited to motion along the length L of the electronics enclosure 10. As the cassette 30 is urged towards the back of the enclosure 10, the sloped surfaces of the hooked ends 192 make contact with the surface of the ledge portion 170 and deflect the flexible beams 90 upward into the cassette 30. Additional sliding of the label cassette 30 through the guide structures 178 causes the hooked ends 192 to snap into respective openings 174 in the ledge portion 170. Thus, the position of the cassette 30 becomes secure along the length L of the enclosure 10. When secured, the lip 196 of the tray 34 is near to or abuts the front edge of the ledge portion 170. In addition, the top surface of the label cassette 30 is level with the top surfaces of the guide structures 178 and the front edge of the label cassette 30 curves like the front edges of the guide structures 178, to provide a smooth, continuous transition between guide structures 178 and the label cassette 30 when the cover 38 is closed.

To detach the cassette 30 from the ledge portion 170 of the electronics enclosure 10, the flexible beams 90 are depressed to disengage the hooked ends 192 from the openings 174 in the ledge portion 170, as the label cassette 30 is pulled through the guide structures 178 towards the front of the enclosure 10 and removed.

While the invention has been shown and described with reference to specific preferred embodiments, it should be understood by those skilled in the art that various changes in form and detail may be made therein without departing from the spirit and scope of the invention as defined by the following claims. For example, although the figures depict an electronics enclosure having two label cassettes, the invention can have any number of label cassettes for attachment to an electronics enclosure. Similarly, the label cassette is depicted with two capture mechanisms and two hinge mechanisms, but it should be recognized that other numbers of capture mechanisms and hinge mechanisms are contemplated. In addition, it is to be understood that label cassettes can be mounted to an enclosure so as to extend from the rear side, rather than the front, of the enclosure.

What is claimed is:

1. A label cassette for an electronics enclosure with guide structures on opposite sides of a cassette surface having an opening therein, the label cassette comprising:

a transparent cover having a back edge;

a tray having a base for providing a label surface for holding a label, the base being bounded on opposite sides by side shoulders, each side shoulder having a guide rail extending laterally along an exterior surface of that side shoulder, the base having an opening formed therein with a flexible capture mechanism disposed in the opening, the flexible capture mechanism having an unattached first end and a second end that is attached to the base, the unattached first end having a projection that extends out of the opening in the base, wherein as the guide rails slide through the guide structures of the electronics enclosure the cassette surface of the electronics enclosure encounters and urges the projection towards the opening in the base until the projection enters the opening in the cassette surface, whereupon the flexible capture mechanism returns to an unflexed position that secures the projection within the opening in the cassette surface; and a hinge mechanism rotatably attaching the transparent cover to the tray for rotation about an axis substantially parallel to the back edge of the transparent cover.

2. The label cassette of claim 1, wherein the transparent cover has two side edges, each side edge having a protrusion extending therefrom and wherein each side shoulder of the tray has an indentation for receiving one of the protrusions of the transparent cover when the label cassette is closed.

3. The label cassette of claim 1, wherein the hinge mechanism comprises:

a hinge pin disposed parallel to the back edge of the transparent cover; and a hinge pin retainer disposed on a back edge of the tray.

4. The label cassette of claim 1, wherein the flexible capture mechanism comprises a flexible beam having a hooked end to enter and engage the opening in the cassette surface of the electronics enclosure.

5. The label cassette of claim 1, further comprising:

at least one tab extending from a front edge of the tray; and at least one recessed region in a front edge of the transparent cover to accept the at least one tab when the label cassette is closed.

6. The label cassette of claim 1, wherein each side shoulder of the tray has a top portion and the transparent cover has an exterior-facing surface that lies flush with the top portion of each side shoulder when the transparent cover is in the closed position.

7. The label cassette of claim 1, wherein the tray has a raised front edge extending between the side shoulders of the tray, the raised front edge of the tray being lower in height than the side shoulders of the tray.

8. The label cassette of claim 7, wherein each side shoulder has a curved front portion and the transparent cover has a curved front portion that couples to the raised front edge of the tray when the transparent cover is in the closed position.

9. The label cassette of claim 8, wherein the curved front portion of the transparent cover lies flush with the curved front portions of the side shoulders of the tray when the transparent cover is in the closed position.

10. An electronics enclosure, comprising:

a base;

an electronics module supported by the base, the electronics module having a panel that is substantially perpendicular to the base;

a label cassette holder comprising an external ledge extending from the base past the panel of the electronics module, the ledge having a cassette surface with an opening formed therein and having a guide structure disposed along one side of the cassette surface; and a label cassette having:

a transparent cover having a back edge;

a tray with a base for providing a label surface for holding a label, the base being bounded on opposite sides by side shoulders, one of the side shoulders having a guide rail extending laterally along an exterior surface of that side shoulder, the base having an opening formed therein with a flexible capture mechanism disposed in the opening, the flexible capture mechanism having an unattached first end and a second end that is attached to the base, the unattached first end having a projection that extends out of the opening in the base, wherein, as the guide rail slides through the guide structure, the cassette surface of the electronics enclosure encounters and urges the projection towards the opening in the base until the projection enters the opening in the cassette surface of the ledge, whereupon the flexible capture mechanism returns to an unflexed position that secures the projection within the opening in the cassette surface; and a hinge mechanism rotatably attaching the transparent cover to the tray for rotation about an axis substantially parallel to the back edge of the transparent cover.

11. The electronics enclosure of claim 10, wherein the transparent cover has two side edges each having a protrusion extending therefrom and wherein the tray has a pair of shoulders disposed at opposite ends of the label surface, each shoulder having an indentation configured to receive the protrusions in the side edges of the transparent cover when the label cassette is in a closed configuration.

12. The electronics enclosure of claim 10 wherein the tray is substantially parallel to the front ledge when secured thereto.

13. The electronics enclosure of claim 10, wherein the hinge mechanism comprises:

a hinge pin disposed parallel to the back edge of the transparent cover; and a hinge pin retainer disposed on a back edge of the tray.

14. The electronics enclosure of claim 10, wherein the capture mechanism comprises a flexible beam having a hooked end to enter and engage the opening in the cassette surface of the ledge.

15. The electronics enclosure of claim 10, further comprising:

at least one tab extending from a front edge of the tray; and at least one recessed region in a front edge of the transparent cover to accept the at least one tab when the label cassette is closed.

16. The electronic enclosure of claim 10, wherein each side shoulder of the tray has a top portion and the transparent cover has an exterior-facing surface that lies flush with the top portion of each side shoulder when the transparent cover is in the closed position.

17. The electronic enclosure of claim 10, wherein the tray has a raised front edge that is lower in height than the side shoulder of the tray.

18. The electronic enclosure of claim 17, wherein each side shoulder has a curved front portion and the transparent cover has a curved front portion that couples to the raised front edge of the tray when the transparent cover is in the closed position, the transparent cover lying flush with the curved front portion of each side shoulder of the tray when the transparent cover is in the closed position.

19. The electronic enclosure of claim 10, wherein the ledge is substantially perpendicular to the panel of the electronics module.

* * * * *